US010507506B2

(12) United States Patent
Reisch et al.

(10) Patent No.: US 10,507,506 B2
(45) Date of Patent: Dec. 17, 2019

(54) HYDRAULIC DRAWING CUSHION OF A DRAWING PRESS AND METHOD OF OPERATING THE HYDRAULIC CUSHION

(71) Applicant: Schuler Pressen GmbH, Göppingen (DE)

(72) Inventors: Dieter Reisch, Göppingen (DE); Michael Micklisch, Göppingen (DE); Michael Richter, Birenbach (DE)

(73) Assignee: Schuler Pressen Gmbh, Goppingen (DE)

( * ) Notice: Subject to any disclaimer, the term of this patent is extended or adjusted under 35 U.S.C. 154(b) by 496 days.

(21) Appl. No.: 14/617,289

(22) Filed: Feb. 9, 2015

(65) Prior Publication Data

US 2015/0224557 A1 Aug. 13, 2015

(30) Foreign Application Priority Data

Feb. 10, 2014 (DE) ..... 10 2014 101 616

(51) Int. Cl.
*B21D 24/02* (2006.01)
*B21D 24/14* (2006.01)
*F15B 15/20* (2006.01)

(52) U.S. Cl.
CPC ..... *B21D 24/02* (2013.01); *B21D 24/14* (2013.01); *F15B 2015/206* (2013.01);
(Continued)

(58) Field of Classification Search
CPC ..... B21D 24/02; B21D 24/14
See application file for complete search history.

(56) References Cited

U.S. PATENT DOCUMENTS 4,840,055 A * 6/1989 Michael ..... B21D 24/08 72/347
5,471,861 A 12/1995 Kirii
(Continued)

FOREIGN PATENT DOCUMENTS

CN 1108762 A 9/1995
CN 101175585 A 5/2008
(Continued)

OTHER PUBLICATIONS

Office action and search report in corresponding Chinese application No. 201510064523.7, dated Jun. 3, 2016, 12 pages.
(Continued)

*Primary Examiner* — Teresa M Ekiert
(74) *Attorney, Agent, or Firm* — Fitch, Even, Tabin & Flannery LLP

(57) ABSTRACT

A hydraulic drawing cushion (17) for a drawing press (10) includes at least one hydraulic cylinder (21) comprising a piston rod (27) that causes a total force (G) to act on the metal sheet holding ring (20). The hydraulic cylinder (21) comprises a hydraulic work circuit (37) to generate a hydraulic work force (A) in a work direction (Z) to act on a ring part (28) to which a force can be applied on both sides. Independently, a spring force (F) acts on the piston (26). The spring force (F) is neither controlled nor adjusted, but is preset. Preferably, the spring force (F) is exclusively a function of the position or location of the piston (26) relative to the cylinder housing (25). The total force (G) acting on the piston (26) results from the addition of the vectors of the work force (A) and the spring force (F).

13 Claims, 3 Drawing Sheets

(52) U.S. Cl.
CPC ..... *F15B 2211/20515* (2013.01); *F15B 2211/20538* (2013.01); *F15B 2211/20561* (2013.01); *F15B 2211/27* (2013.01); *F15B 2211/625* (2013.01); *F15B 2211/6651* (2013.01); *F15B 2211/6653* (2013.01); *F15B 2211/6654* (2013.01); *F15B 2211/7054* (2013.01); *F15B 2211/75* (2013.01); *F15B 2211/76* (2013.01); *F15B 2211/765* (2013.01)

(56) References Cited

U.S. PATENT DOCUMENTS

| | | | | |
|---|---|---|---|---|
| 5,724,843 | A | 3/1998 | Kirii | |
| 6,408,671 | B1 * | 6/2002 | Knodler ..... | B21D 28/002 72/332 |
| 2008/0141668 | A1 | 6/2008 | Micklisch | |
| 2009/0071218 | A1 | 3/2009 | Kohno | |
| 2011/0265544 | A1 | 11/2011 | Micklisch et al. | |

FOREIGN PATENT DOCUMENTS

| | | | |
|---|---|---|---|
| CN | 102407257 | A | 4/2012 |
| DE | 3702069 | A1 | 8/1988 |
| DE | 102006058630 | A1 | 6/2008 |
| DE | 102010019324 | A1 | 11/2011 |
| JP | 2005344776 | A | 12/2005 |

OTHER PUBLICATIONS

Office Action in corresponding Spanish Application No. 201530095, dated Jan. 9, 2018, 7 pages.

German Office Action dated Oct. 7, 2014, for corresponding German Application No. 10 2014 101 616.5 with Machine English translation (10 pages).

* cited by examiner

HYDRAULIC DRAWING CUSHION OF A DRAWING PRESS AND METHOD OF OPERATING THE HYDRAULIC CUSHION

RELATED APPLICATION(S)

This application claims the benefit of German Patent Application No. DE 10 2014 101 616.5 filed Feb. 10, 2014, the contents of which are incorporated herein by reference as if fully rewritten herein.

TECHNICAL FIELD

The invention relates to a hydraulic drawing cushion of a drawing press and to a method for the operation of said drawing cushion.

BACKGROUND

Hydraulic drawing cushions have been used on drawing presses for a long time. During a drawing operation the drawing press clamps a piece of sheet metal between a first tool and a second tool. The two tools are moved relative to each other during a working stroke. In the course of the relative movement, the metal sheet is drawn over a tool mold and pressed between two tool molds of the two tools. In the course of drawing the piece of sheet metal the drawing cushion provides the necessary holding force for the metal sheet.

Such a hydraulic drawing cushion has been known from publication DE 10 2006 058 630 A1, for example. The hydraulic drawing cushion comprises a hydraulic cylinder with a cylinder housing and a piston that can be moved back and forth therein. The piston divides the interior of the cylinder into two work chambers. A first piston area is adjacent the first work chamber and a second piston area is adjacent the second work chamber. A hydraulic medium can be filled into the first or the second work chamber by means of a hydraulic pump in order to move the piston rod and the metal sheet holding ring and to set the metal sheet holding force, respectively.

In conjunction with this, it is a problem that the hydraulic pump and the motor driving the hydraulic pump must provide a large volume flow for a rapid movement of the metal sheet holding ring. The work chambers and the piston areas cannot be arbitrarily configured to be small because the hydraulic pressure could then not generate the sufficient metal sheet holding force. If high accelerations or speeds of the piston or the metal sheet holding ring are required, the motor/pump unit must be dimensioned displaying the appropriate power, thus making the hydraulic drawing cushion considerably more expensive.

In order to avoid this disadvantage, publication DE 10 2010 019 324 A1 suggests that a further, third, work chamber be provided in the cylinder, said work chamber being adjacent to a third piston area. In this embodiment, either the piston rod is moved by the appropriate application of hydraulic pressure to the first or second work chamber, or a holding force is generated via the third work chamber during the drawing operation. This embodiment already has resulted in a few advantages in view of the dimensioning of the motor/pump unit.

SUMMARY

Therefore, an object of the invention can be viewed to be the provision of a simplified hydraulic drawing cushion and a method for the operation of said drawing cushion.

An example hydraulic drawing cushion comprises a hydraulic cylinder with a cylinder housing and a piston with a piston rod. The piston is arranged in the hydraulic cylinder so as to be movable between a first work chamber and a second work chamber and so as to divide these two work chambers in a fluidic manner. A first piston area adjoins the first work chamber, and a second piston area adjoins a second work chamber. The first piston area and the second piston area may have the same or different dimensions. The piston rod projects from the cylinder housing and is connected—on an exterior, free end—to a metal sheet holding ring of the drawing press.

Connected to the first work chamber and the second work chamber is a hydraulic work circuit with a hydraulic pump. The hydraulic pump can convey the hydraulic medium from the first work chamber into the second work chamber or, vice versa, from the second work chamber into the first work chamber. In so doing, the hydraulic pressure and/or the volume flow of the hydraulic medium can be controlled or adjusted in one work chamber via the rotational speed of the hydraulic pump. As the adjustment parameter for setting the rotational speed of the hydraulic pump it is also possible to directly use the position and/or speed and/or the acceleration of the piston rod or the metal sheet holding ring and/or the total force applied to the piston rod or the holding ring. Consequently, the movement and/or position, as well as the force of the piston rod and thus the holding force of the hydraulic drawing cushion are adjusted via the first hydraulic work circuit. It is also possible for the hydraulic drawing cushion to comprise several hydraulic cylinders that are connected to the hydraulic work circuit. Furthermore, it is possible to allocate a separate hydraulic work circuit—each having a hydraulic pump—to each hydraulic cylinder.

Furthermore, the hydraulic drawing cushion comprises a spring device. The spring device generates an essentially constant spring force, said force acting directly or indirectly on the piston. In the exemplary embodiment, the spring device is arranged in or on the cylinder housing of the hydraulic cylinder and is able, for example, to act directly on the face of the piston rod opposite the metal sheet holding ring. The resultant spring force is oriented along the longitudinal axis of the piston rod in order to avoid tilting moments of the piston relative to the cylinder housing.

During the operation of the drawing cushion or the drawing press, the spring force is generated independently of the control or adjustment and the mode of operation—in particular, the rotational speed—of the hydraulic pump in the hydraulic work circuit. The spring force is preset and always exists during the drawing operation. A work force generated by the hydraulic pressure in the first work chamber or in the second work chamber, said force acting on the piston, is generated in addition to the existing spring force and is able to increase or decrease the total force acting on the piston, said total force being oriented in the same direction as the spring force or in the direction opposite said total spring force. Preferably, the spring force is oriented in such a manner that it forces the piston rod to move out of the cylinder housing.

Due to this configuration of the drawing cushion, a portion of the holding force is generated mechanically and/or hydraulically via the spring force. Consequently, only a work force corresponding to the difference between the spring force and the total force to be adjusted on the hydraulic cylinder or the holding force on the metal sheet holding ring needs to be generated via the hydraulic work circuit that is connected to the first two work chambers. This is possible with relatively small piston areas and thus relatively small volumes of the first and second work chambers. The desired dynamics during the movement can thus also be achieved with a hydraulic pump having small dimensions in the hydraulic circuit and a motor having small dimensions, for example a servomotor. It is true, that it may be necessary in conjunction with this that the work force generated in the first hydraulic work circuit act against the existing spring force. However, the work performed, in so doing, is at least partially stored—with the usual loss of efficiency—in the spring device when the piston is moved against the spring force.

Preferably, the spring force is not directly controlled or adjusted and cannot be changed independently of the position of the piston. Thus, the spring force cannot be changed by the hydraulic pressure or the volume flow of the hydraulic medium in the first hydraulic work circuit, or in the first or second work chamber. Preferably, the spring force is prespecified and, in a particularly preferred exemplary embodiment, is exclusively a function of the position of the piston or the piston rod relative to the cylinder housing.

In one exemplary embodiment, a work force generated via the hydraulic work circuit on the first piston area is directed counter the spring force so that the entire force exerted on the piston is smaller than the spring force or acts in the opposite direction. A work force generated on the second piston area is oriented in the same direction as the spring force so that the total force acting on the piston is greater than the spring force.

In a preferred exemplary embodiment, the spring device has a spring constant that is high compared to the maximum piston stroke such that the extent of a force difference between a minimum value and a maximum value of the spring force is at most 10% to 15%. In doing so, the spring force of the spring device is proportional to the spring constant as well as to the path by which the spring device is deflected out of its rest position. Consequently, the spring force changes as a function of the position of the piston between a minimum value and a maximum value. In order to ensure an essentially constant spring force, the spring constant of the spring device is selected appropriately high.

In a preferred exemplary embodiment, the spring device does not comprise an active electrical or electromechanical component during the drawing operation or in the drawing mode. The spring force is generated without the use of active controllable components. When the press is stopped, i.e., when no drawing operation is being performed, securing means may be provided while a safe state of the press and in particular the spring device is established, said securing means being, for example, shut-off valves or mechanical locking means. These securing means do not perform any function during the drawing operation.

Preferably, no electrical energy is converted into mechanical or hydraulic energy for the generation of the spring force. As a result of this, the cylinder and the drawing cushion, respectively, are designed so as to be compact. Electrical connections for supplying the spring device or for its control or adjustment can be omitted.

The spring device may comprise a transmission arrangement that comprises a pressure surface that is force-coupled with the piston so that a force acting on the pressure surface is transmitted to the piston and that there the spring forces acts on the piston. In doing so, the transmission arrangement is configured in such a manner that the pressure surface has a shorter stroke path compared with the piston. As a result of this, the change of the spring force may be minimized as a function of the position or movement of the piston so that the most constant possible spring force is achieved.

Preferably, the spring device is configured as a fluidic spring device. In doing so, the fluidic spring device may comprise a hydraulic medium that is disposed to transmit the spring force to the piston. For this purpose, the spring device may comprise a pressure storage with a hydraulic chamber. The cylinder may have a third work chamber adjacent to a third piston area of the piston. The third work chamber may be connected via a pressure line to the hydraulic chamber of the pressure storage. Adjacent the pressure chamber may be a movable pressure surface. The hydraulic medium in the hydraulic chamber of the pressure storage may be pressurized by means of a pressurized gas or by a mechanical means via the pressure surface. For example, the pressure storage may be configured as a non-gassing membrane storage.

If the spring device is configured as a fluidic spring device, the hydraulic volume in the hydraulic chamber of the pressure storage may vary as a function of the position of the piston. Preferably, the maximum volume in the hydraulic chamber of the pressure storage is greater than the maximum volume of the hydraulic medium in the third work chamber.

In a preferred exemplary embodiment the hydraulic medium of the hydraulic work circuit is completely separated from the hydraulic medium of the fluidic spring device. This simplifies the design features of the drawing cushion.

In a simply configured exemplary embodiment of the hydraulic drawing cushion, the hydraulic work circuit does not comprise a hydraulic supply storage or pressure storage. Alternatively or additionally, it is also possible to configure the hydraulic circuit without hydraulic valves, wherein, at least in the hydraulic connection between the hydraulic pump and the first work chamber and/or the second work chamber, no hydraulic control valve is arranged. In one exemplary embodiment it may be necessary, as described hereinabove, to provide a shut-off vale as a securing means in order to be able to move the press into a safe mode while it is stopped.

A direct hydraulic connection that cannot be locked during the drawing operation, in particular, exists between the respective work chamber and the hydraulic pump.

In one exemplary embodiment, the hydraulic pump of the hydraulic work circuit may be driven in both directions of rotation by an electric motor. As a result of this, the hydraulic medium in the hydraulic work circuit can be driven in both directions between the work chambers, without requiring a hydraulic valve for controlling the volume flow.

Advantageous embodiments of the drawing cushion or the method for operating the drawing cushion can be inferred from the dependent patent claims, from the description, as well as from the drawings. The description is restricted to essential features of the invention. Hereinafter, preferred embodiments of the invention are explained in detail with reference to the attached drawings.

DETAILED DESCRIPTION

Figure 1:
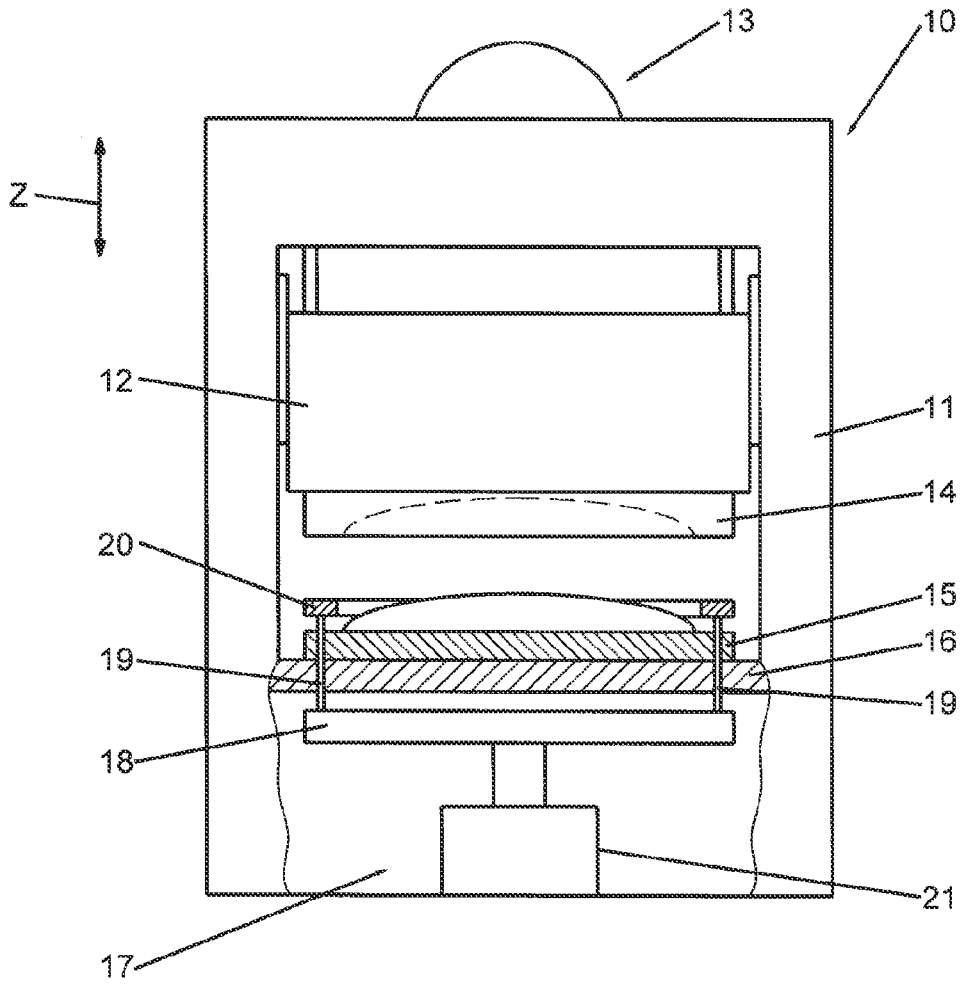
FIG. 1 a schematic view resembling a block circuit diagram of an exemplary embodiment of a drawing press.

FIG. 1 is a schematic illustration of a drawing press 10 with a press frame 11. A ram 12 is arranged on the press frame 11 so as to be movable in a work direction Z, for example in vertical direction. A press drive 13 is disposed for moving the ram 12. Arranged on the ram 12 is a first tool 14. At a distance from the first tool, a second tool 15 is supported by the press frame 11, for example by means of a press table 16.

Furthermore, the drawing press 10 comprises a hydraulic drawing cushion 17. The hydraulic drawing cushion 17 is located on the side of the second tool 15 that faces away from the first tool 14, i.e., in accordance with the example, below the press table 16. A floating plate 18 is associated with the hydraulic drawing cushion 17. Pressure rods 19 are provided on the floating plate 18, said pressure rods extending from the floating plate 18 to the second tool 15. In accordance with the example, the pressure rods 19 extend through the press table 16 and through the second tool 15 and/or past the second tool 15. On the ends of pressure rods 19 opposite the floating plate 18, there is arranged a metal sheet holding ring 20. The metal sheet holding ring 20 can be moved together with the floating plate 18 in a work direction Z. To accomplish this, the floating plate 18 is movably supported in work direction Z by means of at least one hydraulic cylinder 21 relative to the press frame 11. FIG. 1 shows only one single hydraulic cylinder 21. Depending on how the drawing press 10 is dimensioned, the floating plate 18 may also comprise several, preferably identically configured, hydraulic cylinders 21.

Figure 2:
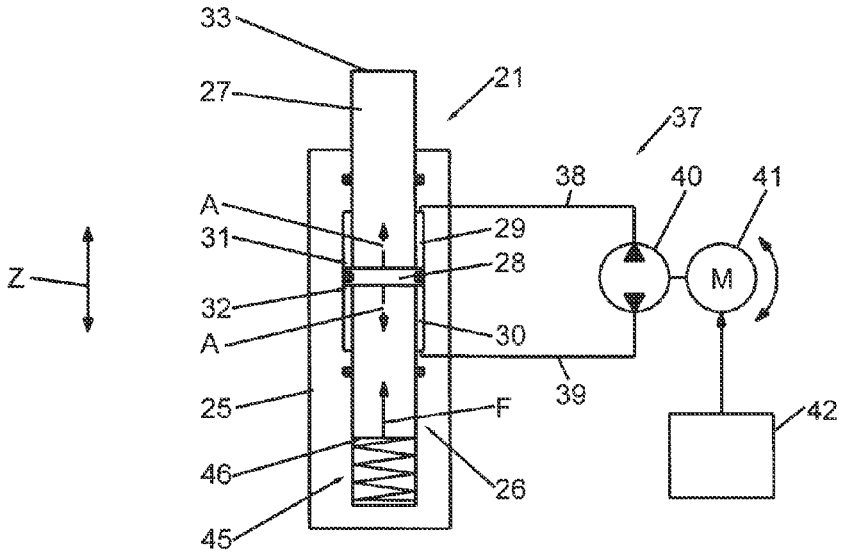
FIG. 2 a schematic representation resembling a block circuit diagram of an exemplary embodiment of a hydraulic cylinder with a spring device.
Figure 3:
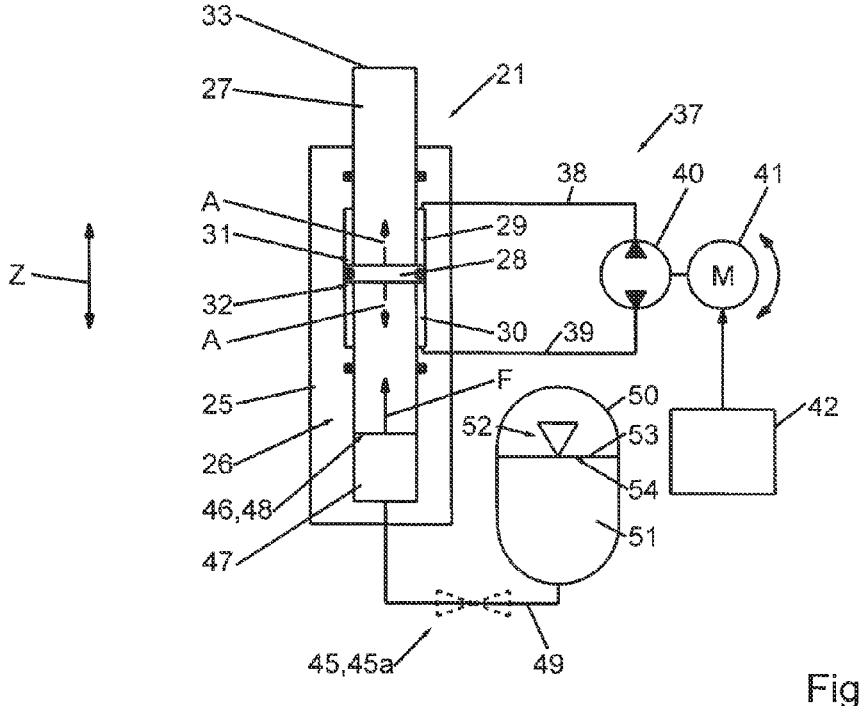
FIG. 3 a schematic representation resembling a block circuit diagram of a modified exemplary embodiment of a hydraulic cylinder with a fluidic spring device.

FIGS. 2 and 3 show exemplary embodiments of a hydraulic cylinder 21, as well as components of the drawing cushion 17 connected to the hydraulic cylinder 21. To avoid confusion, these components that are connected to the hydraulic cylinder 21 are not shown in FIG. 1; however, they are also provided in that case.

The hydraulic cylinder 21 has a cylinder housing 25 and a piston 26 supported in the cylinder housing 25 so as to be movable back and forth in work direction Z. The piston 26 has a piston rod 27 to which a ring part 28 is rigidly mounted. The ring part 28 divides an interior space in the cylinder housing 25 into a first work chamber 29 and a second work chamber 30. The two work chambers 29, 30 are fluidically sealed relative to each other by the ring part 28. Adjacent to the first work chamber 29, a first piston area 31 exists on the ring part 28 and, adjacent to the second work chamber 30, a second piston area 32 exists. The first piston area 31 and the second piston area 32 are each configured as annular surfaces and have the same size in the preferred exemplary embodiment. In accordance with the example, the first work chamber 29 and the second work chamber 30 have a cylindrical shape and, in particular, the shape of a circular cylinder.

The piston rod 27 projects at least on one side and, preferably, only on one side, from the cylinder housing 25 and has a free end 33 at that location. The free end 33 of the piston rod 27 is connected to the floating plate 18 in the drawing press 10.

The first two work chambers 29, 30 of the hydraulic cylinder 21 are in fluidic communication with a hydraulic work circuit 37. The hydraulic work circuit 37 comprises a first hydraulic line 38 that is in fluidic communication with the first work chamber 29, as well as a second hydraulic line 39 that is in fluidic communication with the second work chamber 30. The two hydraulic lines 38, 39 are connected to a hydraulic pump 40 and indirectly connected to each other by the interposed hydraulic pump 40. The hydraulic pump 40 can be operated in both directions of rotation. For driving the hydraulic pump 40, a motor is used, i.e., an electric motor 41 in accordance with the example. In the exemplary embodiment, the electric motor 41 is actuated via a control unit 42. The control unit 42 may control and/or adjust the operating parameters of the electric motor 21 such as, for example, the rotational speed n, the direction of rotation, the electric current of the motor or the like. Adjustment parameters for the control unit 42 may also be the volume flow of the hydraulic volume conveyed by the hydraulic pump 40 and/or the hydraulic pressure in one of the two hydraulic lines 38, 39 or in one of the two work chambers 29, 30. All mentioned parameters can be controlled or adjusted individually or, together, in any desired combination. The rotational speed n and/or other operating parameters of the hydraulic pump 40 can also be set for the adjustment of the position and/or the speed and/or the total force G acting on the piston rod 27.

The first piston area 31 and the second piston area 32 may also be dimensioned differently. This results in different-size volume flows of the hydraulic pump 40 into or out of the work chambers 29, 30 when the piston 26 is being moved, so that appropriate compensation means may be provided in the hydraulic work circuit 37. The hydraulic work circuit 37 is half open, as it were.

Considering the preferred exemplary embodiments of the hydraulic drawing cushion 17 illustrated here, no hydraulic components that can be activated or actuated during the drawing operation such as, for example actuatable hydraulic valves, are inserted in the first hydraulic line 38 and the second hydraulic line 39. The hydraulic medium can be conveyed out of the first work chamber 29 and into the second work chamber 30 by means of the hydraulic pump 40. Conversely, the hydraulic medium can be conveyed from the second work chamber 30 into the first work chamber 29. A work force A can be set on the piston 26 by means of the hydraulic pressure set in the first work chamber 29 and the second work chamber 30, respectively. The work force A is oriented in work direction Z. Depending on which of the two work chambers 29, 30 is subjected to pressure, the work force A forces the piston rod 27 out of the cylinder housing 25 into the completely moved-out position, or the work force A forces the piston rod 27 into the cylinder housing 25 into the completely moved-in position. The work force A may also be equal to zero if the hydraulic pump 40 is in idle mode.

When the press is stopped, i.e., when no drawing operation is being performed, a safe mode of the press can be established with appropriate securing means (not illustrated), for example shut-off valves in one or more hydraulic lines, or mechanical locking means. These securing means are not active during a drawing operation.

Furthermore, the hydraulic drawing cushion 17 comprises a spring device 45. The spring device 45 generates a spring force F that acts on the piston 26 and, in accordance with the example, on piston rod 27. The spring force F acts in work direction Z. The spring force F is oriented in such a manner that it displaces the piston rod 27 from the cylinder housing 25 into its completely moved-out position. The work force A that is generated by the hydraulic work circuit 37 can be oriented in the same direction as the spring force F and increase said spring force or the spring force F may be oriented in opposite direction and decrease said spring force. The sum of the spring force F and the prevailing work force A results in a total force G that acts on the piston 26. The quantity of the spring force F is always greater than zero.

The spring device 45 may be a mechanical, fluidic or a combined spring device. In the exemplary embodiment as in FIG. 2, the spring device 45 is only illustrated schematically as an example in the form of a helical spring. The spring device 45 may be arranged in or on the cylinder housing 25. Preferably, the spring device 45 is coupled with the piston rod 27 in such a manner that the spring force F is inserted along the longitudinal axis of the piston rod 27 in order to avoid a tilting of the piston rod 27 relative to the cylinder housing 25. Preferably, the spring device 45 acts on the front side on the piston rod 27. For example, the face 46 of the piston rod 27 that exists on the end opposite the free end 33 may act as a contact surface for the spring device 45. The size of the face 46 of the piston rod 27 can be increased or decreased—if necessary—by an appropriately configured cylindrical end piece on the piston rod 27.

In accordance with the example, the spring device 45 generates an essentially constant spring force F which, in the exemplary embodiments described herein, is only a function of the position of the piston 26 in work direction Z. Other than that, the spring force F cannot be controlled or adjusted, or be influenced by other parameters. Therefore, in an unchanged position of the piston, the spring force F is constant.

Figure 5:
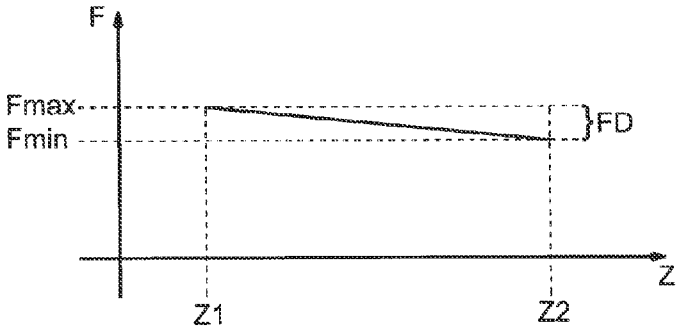
FIG. 5 a schematic representation of the spring force as a function of the position of the piston.

The dependency of the spring force F on the position of the piston 26 in work direction Z is schematically illustrated by FIG. 5. The piston 26 can be moved between a first position Z1 in which the piston rod 27 is completely retracted and a second position Z2 in which the piston rod 27 is completely moved out. In doing so, the following relationship applies, based on Hooke's Law:

$$\Delta F = D \cdot \Delta Z$$

wherein F is the change of the spring force F, ΔZ is the change of the position of the piston 26 in work direction Z, and D is the spring constant of the spring device 45.

As is obvious from FIG. 5, the spring force F changes between a maximum value Fmax in the first position Z1 of the piston 26, in which the piston rod 27 is completely moved in, and a minimum value Fmin in the second position Z2 of the piston 26, in which the piston rod 27 is completely moved in. The force difference FD between the maximum value Fmax and the minimum value Fmin of the spring force F should be as low as possible. The force difference FD can be influenced by the embodiment of the spring device 45 and is at most 10% to 15% of the maximum value Fmax of the spring force F in one exemplary embodiment.

In particular, the spring force F is not a function of the work force A that is generated on the piston 26 via the hydraulic work circuit 37 or the hydraulic pump 40. The rotational speed n of the hydraulic pump 40, the volume flow or the hydraulic pressure in the hydraulic work circuit 37 do not influence the spring force F.

Preferably, the spring device 45 comprises no electrically components that can be electrically activated. Consequently, the spring force F cannot be controlled or adjusted during the operation of the hydraulic drawing cushion. However, there may be a provision for setting the spring force F when the drawing press 10 is set up, dependent of the reshaping task of the drawing press 10, and for adapting the maximum possible work force A. This setting then remains unchanged during the entire operation of the drawing press 10. In accordance with the example, the spring force F only changes as a function of the position of the piston 26.

Referring to the exemplary embodiment shown by FIG. 3, the spring device 45 is configured as a fluidic spring device 45*a*. In doing so, the spring force F is transmitted to the piston 26 by a fluid and, in accordance with the example, by a hydraulic medium. To accomplish this, a third work chamber 47 adjoined by a third piston area 48 is provided in the cylinder housing. Referring to the exemplary embodiment shown here, the third piston area 48 of the piston 26 is the face 46. The third piston area 48 is greater than the first piston area 31 and the second piston area 32 and, in accordance with the example, is at least greater by a factor of 5.

The third work chamber 47 is connected to a pressure storage 50 via a pressure line 49. For example, a membrane storage or the like can be used as the pressure storage. The pressure storage 50 comprises a hydraulic chamber 51. Located inside the hydraulic chamber, there is a specific volume percentage of the hydraulic medium that can be shifted between the third work chamber 47 and the pressure chamber 51 via the pressure line 49. The pressure storage 50 comprises a force generating means 52. The force generating means 52 can generate, for example mechanically and/or fluidically, a force acting on a pressure element 53. The pressure element 53 is supported in the pressure storage 50 in a movable and, in particular, in a shiftable manner in the pressure storage, for example a piston, a membrane or the like.

The pressure element 53 has a pressure area 54 that pushes against the hydraulic medium in the pressure chamber 51. In doing so, the pressure area 54 is larger than the third work area 48 or the face 46 of the piston 26. Preferably, the pressure area 54 is larger by at least the factor of 5 to 10 than the third work area 48. As a result of this, it is achieved, for example, that the change of the spring force F due to a changing position of the piston 26 is sufficiently small and remains in a prespecified region between the minimum value Fmin and the maximum value Fmax of the spring force F.

The volume of the pressure chamber 51 of the pressure storage 50 when the piston rod 27 is completely moved in is greater than the volume of the third work chamber 47 when the piston rod 27 is completely moved out. In other words: The maximum volume of the pressure chamber 51 is greater than the maximum volume of the third work chamber 47. As a result of this, it is ensured that hydraulic medium always remains in the pressure chamber 51.

The spring device 45 may comprise a transmission arrangement so that the generated force is transmitted to the piston 26 and generates a spring force F at that location. Considering the fluidic spring device 45*a*, it is the pressure area 54, the hydraulic chamber 51, the pressure line 49, the third work chamber 47 and the third piston area 48 that form the transmission arrangement. The latter transmits the force generated by the force generating means 52 to the piston 26.

The main difference between the embodiment as in FIG. 2 and the embodiment as in FIG. 3 of the hydraulic drawing cushion 17 consists in that the spring device 45 as in FIG. 2 generates a spring force F acting directly on the piston 26. In a fluidic spring device 45*a* as in FIG. 3, the force of the force generating means 52 is transmitted via the hydraulic medium to the piston 26. In doing so, a transmission can be achieved due to the surface ratio between the third work area 48 and the pressure area 54. Furthermore, the maximum distance traveled by the pressure area 54 or the pressure element 53 can be shorter than the maximum piston stroke of the piston 26 between its first position Z1 and its second position Z2. Consequently, the position-dependent change of the spring force F that acts through the fluidic spring device 45*a* on the piston 26 can be kept low.

The hydraulic medium of the hydraulic work circuit 37 is completely separate from the hydraulic medium of the fluidic spring device 45*a*. The fluidic spring device 45*a* can thus form a module without external fluidic and/or electrical connections, which module can also be embodied as an integral part with the cylinder housing 25 or be installed on said cylinder housing.

Figure 4:
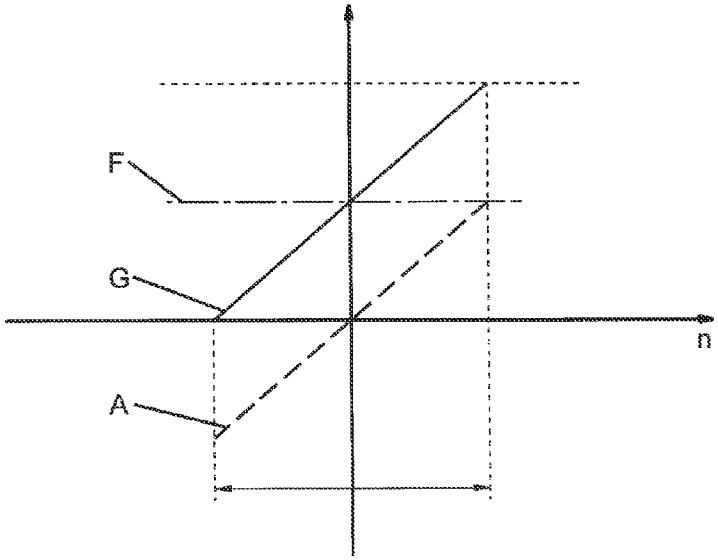
FIG. 4 a schematic representation of the spring force, the work force and the resultant total force acting on the piston of the cylinder as a function of the rotational speed of the hydraulic pump.

The total force G is schematically represented as an example by FIG. 4, wherein said total force acts on the piston 26 as a function of the rotational speed n of the hydraulic pump 40. The dashed line indicates the work force A that is attained due to the hydraulic circuit 37 and thus the hydraulic pump 40. In doing so, negative rotational speeds of the hydraulic pump 40 correspond to a conveying direction of the hydraulic pump 40 in the first work chamber 29, whereas positive rotational speeds n illustrate the opposite conveying direction into the second work chamber 30.

FIG. 4 shows the spring force F as a function of the rotational speed n. As described hereinabove, the spring force F may slightly change as a function of the position of the piston 26, however not as a function of the rotational speed n of the hydraulic pump 40, so that the spring force F in FIG. 4 remains constant. The sum of the work force A and the spring force F results in the total force G that acts on the piston 26. In the exemplary embodiment, the spring force F is selected such that the total force G cannot become lower than zero and that thus the direction of the total force G cannot be changed. The consequence of this is that only a total force G acts on the piston 26, said total force displacing the piston rod into the moved-out position. The inward movement of the piston rod occurs during the drawing operation through the force of the ram 12 that acts on the metal sheet holding ring 20 via the first tool 14 while the drawing operation is being performed.

Consequently, by varying the rotational speed n of the hydraulic pump 40, the total force G can varied and adjusted during the drawing operation. In so doing, the total force G may also be controlled or adjusted, for example, as a function of the position or the movement of the ram 12.

If the hydraulic drawing cushion 17 comprises only one hydraulic cylinder 21, the holding force that is applied via the metal sheet holding ring 20 to the metal sheet to be reshaped corresponds to the total force G. If several hydraulic cylinders 21, each comprising a hydraulic work circuit 37 and a spring device 45, are provided, the holding force of the metal sheet holding ring 20 results from the sum of the respective total forces G of the individual hydraulic cylinders 21.

The invention relates to a hydraulic drawing cushion 17 for a drawing press 10. The hydraulic drawing cushion 17 comprises at least one hydraulic cylinder 21 comprising a piston rod 27 that causes a total force G to act on the metal sheet holding ring 20. The hydraulic cylinder 21 comprises a hydraulic work circuit 37 by means of which a hydraulic work force A can be generated in a work direction Z to act on a piston's 26 ring part 28 to which a force can be applied on both sides. Independent of the work force A generated by the hydraulic work circuit 37 to act on the piston 26 of the hydraulic cylinder 21, a spring force (F) acts on the piston (26). The spring force F is generated by a spring device 45. The spring force F is neither controlled nor adjusted, but is preset. Preferably, the spring force F is exclusively a function of the position or location of the piston 26 relative to the cylinder housing 25. The total force G acting on the piston 26 results from the addition of the vectors of the work force A and the spring force F.

LIST OF REFERENCE SIGNS

10 Drawing press
11 Press frame
12 Ram
13 Press drive
14 First tool
15 Second tool
16 Press table
17 Hydraulic drawing cushion
18 Floating plate
19 Pressure rod
20 Metal sheet holding ring
21 Hydraulic cylinder
25 Cylinder housing
26 Piston
27 Piston rod
28 Ring part*
29 Work chamber
30 Second work chamber
31 First piston area
32 Second piston area
33 Free end of the piston rod
37 Working hydraulic circuit
38 First hydraulic line
39 Second hydraulic line
40 Hydraulic pump
41 Electric motor
45 Spring device
45*a* Fluidic spring device
46 Face
47 Third work chamber
48 Third piston area
49 Pressure line
50 Pressure accumulator
51 Pressure chamber
52 Force generating means*
53 Pressure element
54 Pressure area
A Work force
D Spring constant
F Spring force
G Total force
Z Work direction
Z1 First position
Z2 Second position

What is claimed is:

1. A drawing press (10), comprising:

a floating plate (18) configured to move in a work direction, a drawing cushion (17) comprising:

a hydraulic cylinder (21) comprising a cylinder housing (25) and a piston (26) with a piston rod (27), wherein the piston rod is configured to drive the floating plate (18), a plurality of hydraulic work chambers (29, 30) including a first work chamber, a second work chamber, and a third work chamber provided in the cylinder housing (25), a spring device (45) configured as a fluidic spring device (45*a*) and configured to apply an essentially constant spring force (F) to the piston (26) during operation of the drawing press (10), a first piston area (31) is adjacent to the first work chamber (29), and a second piston area (32) is adjacent to the second work chamber, and wherein the first work chamber (29) and the second work chamber (30) are connected to a hydraulic pump (40) of a hydraulic work circuit (37), wherein the fluidic spring device (45*a*) comprises a pressure storage (50) that is connected to the third work chamber (47) of the cylinder (21) via a pressure line (49), wherein the third work chamber (47) is adjacent to a third piston area (48) of the piston (26).

2. A drawing press (10) as in claim 1, wherein the spring force (F) is not a function of a hydraulic pressure or a volume flow of the first work chamber's (29) and/or in the second work chamber's (30) hydraulic medium.

3. A drawing press (10) as in claim 1, wherein the hydraulic pump (40) of the hydraulic work circuit (37) is configured to generate a hydraulic pressure in the first work chamber (29) or in the second work chamber (30), said hydraulic pressure generating a work force (A) on the respective first piston area (31) or the second piston area (32).

4. A drawing press (10) as in claim 3, wherein the work force (A) generated on the first piston area (31) acts counter the spring force (F), and that the work force (A) generated on the second piston area (32) acts in the spring force (F) direction.

5. A drawing press (10) as in claim 1, wherein the spring force (F) is only a function of the piston's (26) position (Z1, Z2).

6. A drawing press (10) as in claim 1, wherein the spring device (45) has a spring constant (D) that is high relative to a maximum piston stroke (Z2-Z1) such that a force difference (FD) between a minimum value (Fmin) and a maximum value (Fmax) of the spring force (F) is at most 10% to 15% of the maximum value (Fmax) of the spring force (F).

7. A drawing press (10) as in claim 1, wherein the spring device (45) is designed without active electrical and electromechanical components.

8. A drawing press (10) as in claim 1, wherein a maximum hydraulic volume of hydraulic medium in the pressure storage (50) is greater than the third work chamber's (47) maximum volume.

9. A drawing press (10) as in claim 1, wherein the hydraulic work circuit's (37) hydraulic medium is completely separate from the fluidic spring device's (45*a*) hydraulic medium.

10. A drawing press (10) as in claim 1, wherein the hydraulic pump (40) of the hydraulic work circuit (37) can be driven by an electric motor (41) in both directions of rotation.

11. The drawing press of claim 1 wherein the spring device (45) is configured to apply the first spring force (F) to the piston (26) in support of a drawing operation of the drawing press.

12. Method of operating a drawing press (10) comprising a floating plate (18) configured to move in a work direction and a hydraulic drawing cushion (17) comprising a hydraulic cylinder (21) comprising a cylinder housing (25) and a piston (26) with a piston rod (27), wherein the piston rod (27) is configured to drive the floating plate (18), a plurality of hydraulic work chambers (29, 30) including a first work chamber, a second work chamber, and a third work chamber are provided in the cylinder housing (25), and a first piston area (31) is adjacent to the first work chamber (29) and a second piston area (32) is adjacent to the second work chamber, the method comprising:

controlling and/or adjusting one or more of the piston's (26) position, movement, and/or holding force or the floating plate (18) by control or adjustment of hydraulic pressure and/or volume flow of the first or second work chamber's (29, 30) hydraulic medium, and applying a spring force (F) to the piston (26) by a spring device (45) configured as a fluidic spring device (45*a*) without directly controlling or adjusting the spring force (F) during operation of the drawings press (10), wherein the fluidic spring device (45*a*) comprises a pressure storage (50) that is connected to the third work chamber (47) of the cylinder (21) via a pressure line (49), wherein the third work chamber (47) is adjacent to a third piston area (48) of the piston (26).

13. The method of claim 12 wherein the applying the spring force (F) comprises applying the spring force to bias the piston (26) in support of a drawing operation of the drawing press.

* * * * *